US006071359A

United States Patent [19]

Wisniewski et al.

[11] Patent Number: 6,071,359

[45] Date of Patent: Jun. 6, 2000

[54] SHOT FOR USE AS AMMUNITION

[75] Inventors: Jurgen Wisniewski, Wesel; Jochen Spriestersbach, Marl, both of Germany

[73] Assignee: Grillo-Werke AG, Duisburg, Germany

[21] Appl. No.: 08/957,377

[22] Filed: Oct. 24, 1997

[30] Foreign Application Priority Data

Oct. 24, 1996 [DE] Germany ..... 196 44 235

[51] Int. Cl.[7] ..... C22C 7/00; F42B 5/24

[52] U.S. Cl. ..... 148/400; 102/501; 420/524; 420/514; 420/515; 420/517; 420/518; 420/558; 420/560; 420/589; 148/441; 148/442

[58] Field of Search ..... 420/524, 514, 420/515, 517, 518, 558, 560, 589; 102/501; 148/400, 441, 442

[56] References Cited

U.S. PATENT DOCUMENTS 2,119,876 6/1938 Corson ..... 102/26

5,491,035 2/1996 Carey, II et al. ..... 428/647

FOREIGN PATENT DOCUMENTS 0 655 604 5/1995 European Pat. Off. .

357108266 7/1982 Japan .

4-247860 9/1992 Japan .

2 211 920 7/1989 United Kingdom .

94/25817 11/1994 WIPO .

*Primary Examiner*—Sikyin Ip

*Attorney, Agent, or Firm*—Jacobson, Price, Holman & Stern, PLLC

[57] ABSTRACT

Tin and zinc based shot for use as ammunition having a diameter of from 1.5 to 5.5 mm, containing, by weight, in addition to tin and the usual unavoidable contaminants, from 12 to 60% of zinc and from 0 to 5% of aluminum, but less than 0.1% of copper, less than 0.1% of iron, and less than 1% of lead.

7 Claims, No Drawings

SHOT FOR USE AS AMMUNITION

The present invention relates to tin and zinc based shot for use as ammunition having a diameter of from 1.5 to 5.5 mm.

From U.S. Pat. No. 5,500,183, it is known to produce bullets, but also cartridge shot, not from lead, but instead from alloys which predominantly contain tin and in addition from 0.2 to 10% by weight of copper, wherein antimony, zinc, magnesium, aluminum are mentioned as further alloy components. If zinc is employed, the amount thereof is to be from 0.005 to 10% by weight, preferably from 0.001 to 1% by weight.

This material already meets the requirement of being virtually free of lead and cadmium, which are no longer to be used for environmental reasons. The copper content is considered essential for the interior and exterior ballistic properties of the bullets. However, it has been found that the use of copper-containing alloys results in a very severe undesirable discoloration of wood if grains of such shot enter into wood which is to be processed into veneer.

Especially for the use in forests, steel shots have not proven suitable. In Denmark, they have already been banned since they can cause severe damages to cutting tools in the processing of wood and moreover cause rust staining and discoloration effects.

In addition, steel bullets tend to ricochet and thus to great hazards when used in hunting since they fail to absorb deformation energy upon the impact (Report of DEVA Altenbeken, June 1992, for Deutscher Jagdschutz-Verband of Bonn, Germany).

Zinc-based shot, prepared, for example, according to GB-A2,211,920, has proven quite useful in sports shooting and hunting (cf. Die Pirsch, 1995, issue 10), but grains of such shot are still capable, under some conditions, of damaging the cutting tools of veneer and wood industries.

From WO 94/25817, it is known to prepare shot ammunition or bullet ammunition from an alloy containing at least 55% of zinc, the balance being bismuth and tin, wherein the tin content can be a maximum of 10%. Alloys are preferred which contain 70% of zinc and up to 30% by weight of bismuth and only minor amounts of tin. Such ammunition is not suitable for hunting, but only as ammunition for sports shooting.

Thus, it has been the object of the present invention to provide shot which is virtually free of lead and non-toxic, has good ballistic properties, is readily processed, and does not cause any damage to wood cutting tools when remaining in wood, very much like lead. Further, grains remaining in wood shall not cause any discoloration of the wood. In addition, the shot material must not cause any operating troubles or quality problems in the paper and cellulose industries, for those industries utilize waste-products from wood processing.

These objects have now been achieved by tin and zinc based shot, characterized by containing, by weight, in addition to tin and the usual unavoidable contaminants, from 12 to 60% of zinc and from 0 to 5% of aluminum, but less than 0.1% of copper, less than 0.1% of iron, and less than 1% of lead.

Particularly good results have been achieved with such shot which contains from 20 to 40% by weight of zinc and from 0.05 to 0.15% of aluminum, in addition to tin. Preferably, the grains of shot contain less than 0.05% of copper, less than 0.05% of iron, and less than 0.5% of lead.

The shot according to the invention can be prepared in the usual way by casting the liquid alloy from gravity dies into a sufficiently high tower filled with air or into a liquid bath which results in quicker cooling. Another preparation method, though more complicated, consists in processing the alloy into a wire which is processed into grains of shot by an appropriate section roll. The remaining wire residues can be recycled.

Preferably, there is used an alloy of about 70% of tin and about 30% of zinc which is readily cast.

Alloys which are less suitable for casting can be processed into useful shot by processing into a wire followed by pressing into grains.

From the above mentioned purity requirements for grains of shot, it can be seen that all tin grades in accordance with DIN 1704 can be employed in principle, the grades tin 99.95 to tin 99.50 being preferred, however, since they contain less copper, less iron and less lead.

When zinc is used as an alloy component, all zinc grades in accordance with EN 1179 can be used in principle, the zinc types Z1 to Z4 being again preferred for containing significantly less lead, iron and copper.

As to aluminum, the quality requirements need not be so strict, all the less so since it is added in relatively small amounts and thus causes only minor contaminations with additional alloy elements.

What is claimed is:

1. Ammunition shot having a diameter of 1.5 to 5.5 mm comprising, by weight, in addition to tin, 20 to 60% zinc, 0 to 5% aluminum, less than 0.1% copper, less than 0.1% iron, and less than 1% lead.

2. The shot of claim 1, wherein zinc is included at 20 to 40% by weight.

3. The shot according to claim 1, including aluminum at 0.05 to 0.15% by weight.

4. The shot according to claim 1, including less than 0.05% copper, less than 0.05% iron, and less than 0.05% lead.

5. The shot according to claim 2, including aluminum at 0.05 to 0.15% by weight.

6. The shot according to claim 2, including less than 0.05% copper, less than 0.05% iron, and less than 0.5% lead.

7. The shot according to claim 6, including less than 0.05% copper, less than 0.05% iron, and less than 0.5% lead.

* * * * *